US010851443B2

(12) United States Patent
Hassan et al.

(10) Patent No.: US 10,851,443 B2
(45) Date of Patent: Dec. 1, 2020

(54) MAGNESIUM COMPOSITE CONTAINING PHYSICALLY BONDED MAGNESIUM PARTICLES

(71) Applicant: KING FAHD UNIVERSITY OF PETROLEUM AND MINERALS, Dhahran (SA)

(72) Inventors: Syed Fida Hassan, Dhahran (SA); Nasser Al-Aqeeli, Dhahran (SA); Nasirudeen Olalekan Ogunlakin, Dhahran (SA)

(73) Assignee: King Fahd University of Petroleum and Minerals, Dhahran (SA)

( * ) Notice: Subject to any disclaimer, the term of this patent is extended or adjusted under 35 U.S.C. 154(b) by 0 days.

(21) Appl. No.: 16/443,328

(22) Filed: Jun. 17, 2019

(65) Prior Publication Data

US 2019/0300989 A1 Oct. 3, 2019

Related U.S. Application Data

(62) Division of application No. 15/182,060, filed on Jun. 14, 2016, now Pat. No. 10,370,744.

(51) Int. Cl.
*C22C 23/00* (2006.01)
*B22F 3/20* (2006.01)
(Continued)

(52) U.S. Cl.
CPC ..... *C22C 23/00* (2013.01); *B22F 3/20* (2013.01); *C22C 1/0408* (2013.01); *C22C 32/0005* (2013.01); *C22C 32/0036* (2013.01); *B22F 1/0003* (2013.01); *B22F 3/04* (2013.01); *B22F 9/04* (2013.01); *B22F 2998/10* (2013.01); *C22C 1/1084* (2013.01)

(58) Field of Classification Search
CPC . B22F 9/04; B22F 3/04; C22C 1/0408; C22C 23/00; C22C 32/0005; C22C 32/0036
USPC ..... 420/402
See application file for complete search history.

(56) References Cited

U.S. PATENT DOCUMENTS 7,509,993 B1 3/2009 Turng et al.
9,878,370 B2 * 1/2018 An ..... B22F 3/10
2016/0101468 A1 4/2016 An et al.

FOREIGN PATENT DOCUMENTS

CN 104353825 A 2/2015

OTHER PUBLICATIONS

Koichi Kitazono, et al., "Mechanical Properties of Titanium Particles Dispersed Magnesium Matrix Composite Produced through Accumulative Diffusion Bonding Process", Materials Transactions, vol. 52, No. 2, 2011, pp. 155-158.
(Continued)

*Primary Examiner* — Jie Yang
(74) *Attorney, Agent, or Firm* — Oblon, McClelland, Maier & Neustadt, L.L.P.

(57) ABSTRACT

A reinforced magnesium composite, and a method of producing thereof, wherein the reinforced magnesium composite comprises elemental magnesium particles, elemental nickel particles, and one or more ceramic particles with elemental nickel particles being dispersed within elemental magnesium particles without having intermetallic compounds therebetween. Various embodiments of the method of producing the reinforced magnesium composite are also provided.

11 Claims, 6 Drawing Sheets

(51) Int. Cl.

| | |
|---|---|
| ***C22C 1/04*** | (2006.01) |
| ***C22C 32/00*** | (2006.01) |
| *B22F 9/04* | (2006.01) |
| *B22F 1/00* | (2006.01) |
| *B22F 3/04* | (2006.01) |
| *C22C 1/10* | (2006.01) |

(56) References Cited

OTHER PUBLICATIONS

S. Fida Hassan, et al., "Magnesium-nickel composite: Preparation, microstructure and mechanical properties", Journal of Alloys and Compounds, vol. 646, 2015, pp. 333-338.

* cited by examiner

50 μm

Magnesium
Nickel
1 μm cracking

MAGNESIUM COMPOSITE CONTAINING PHYSICALLY BONDED MAGNESIUM PARTICLES

CROSS-REFERENCE TO RELATED APPLICATIONS

The present application is a Divisional of Ser. No. 15/182,060, now allowed, having a filing date of Jun. 14, 2016.

BACKGROUND OF THE INVENTION

Technical Field

The present invention relates to a reinforced magnesium composite and a method of producing thereof, wherein the reinforced magnesium composite comprises elemental magnesium particles, elemental nickel particles, and one or more ceramic particles with the elemental nickel particles being dispersed within elemental magnesium particles without having intermetallic compounds therebetween.

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

An increasing demand for lightweight structural materials in recent decades has met with simultaneous surge in the development of magnesium based materials [I. J. Polmear, Light Alloys: from Traditional Alloys to Nanocrystals, fourth ed., Butterworth Heinemann, London, U K, 2005; K. U. Kainer, F. von Buch, in: K. U. Kainer (Ed.), Magnesium e Alloys and Technology, Wiley-VCH Verlag GmbH & Co, Weinheim, Germany, 2003]. Aerospace, automobile, electronic, bio-implant and consumer product related industries have been seeking for metallic magnesium based structural materials. Magnesium is considered to be one of the lightest metals with a relatively large strength-to-weight ratio, and on the other hand the virtually unlimited quantity (eighth most common element in earth crust and third most common element in dissolved seawater minerals [K. U. Kainer, F. von Buch, in: K. U. Kainer (Ed.), Magnesium e Alloys and Technology, Wiley-VCH Verlag GmbH & Co, Weinheim, Germany, 2003]) of magnesium make it a great candidate to be widely used as a structural material. Apart from being lightweight, the higher preference of magnesium based materials over other lighter metals like aluminum and titanium is due to relatively good castability, machinability, dimensional stability, damping capacity, electromagnetic radiation resistance and low power consumption [I. J. Polmear, Light Alloys: from Traditional Alloys to Nanocrystals, fourth ed., Butterworth Heinemann, London, U K, 2005; K. U. Kainer, F. von Buch, in: K. U. Kainer (Ed.), Magnesium e Alloys and Technology, Wiley-VCH Verlag GmbH & Co, Weinheim, Germany, 2003; J. Faresdick, F. Stodolksy, Lightweight materials for automotive applications, Technical report, Global Information Inc, 2005]. However, relatively low strength and ductility of magnesium limits the wide range of industrial applications of magnesium. Reinforcement with stiffer and stable particles has been investigated to overcome these limitations of magnesium. It has been shown that incorporation of reinforcement particles in a magnesium composite largely depends on the processing steps, and also type, size, volume fraction, and morphology of the reinforcement particles. Although ceramic particles [Yantao Yao, Liqing Chen, J. Mater. Sci. Technol. 30 (7) (2014) 661; X. Y. Gu, D. Q. Sun, L. Liu, Mater. Sci. Eng. A 487 (1e2) (2008) 86; G. Garces, E. O~norbe, P. Perez, M. Klaus, C. Genzel, P. Adeva, Mater. Sci. Eng. A 533 (2012) 119; M. J. Shen, X. J. Wang, C. D. Li, M. F. Zhang, X. S. Hu, M. Y. Zheng, K. Wu, Mater. Desn 54 (2014) 436; Xuezhi Zhang, Qiang Zhang, Henry Hu, Mat. Sci. Eng. A 607 (2014) 269; P. P. Bhingole, G. P. Chaudhari, S. K. Nath, Comp. Part A: Appl. Sci. Manuf 66 (2014) 209; D. J. Lloyd, Int. Mat. Rev. 39 (1) (1994)] have been largely investigated to reinforce magnesium, metal particles [S. F. Hassan, M. Gupta, J. Mat. Sci. 37 (2002) 2467; S. F. Hassan, M. Gupta, Mater. Sci. Tech. 19 (2003) 253; S. F. Hassan, M. Gupta, J. Alloys Compd. 345 (2002) 246; S. F. Hassan, K. F. Ho, M. Gupta, Mater. Let. 58 (16) (2004) 2143; W. W. L. Eugene, M. Gupta, Adv. Eng. Mater. 7 (4) (2005) 250; J. Umeda, M. Kawakami, K. Kondoh, A. EL-Sayed, H. Imai, Mater. Chem. Phys. 123 (2010) 649; Y. L. Xi, D. L. Chai, W. X. Zhang, J. E. Zhou, Scrip. Mater. 54 (2006) 19; Z. L. zhi, Z. M. juan, L. Na, Y. Hong, Z. J. song, Trans. Nonferr. Met. Soc. China 20 (2010)] have also been reported as effective reinforcement particles. Among the reinforcement metal particles, elemental nickel was found to be one of the most promising in enhancing the strength of magnesium when incorporated via ingot metallurgy process. Nickel has a negligible solid solubility in magnesium (up to 0.04 atomic percent at 500° C.) [A. A. Nayeb-Hashemi, J. B. Clark, Bul. Alloy Phas. Diag 6 (3) (1985) 238], however, it reacts with magnesium to produce stable intermetallic compounds at an elevated temperature. Therefore, a considerable formation of magnesium-nickel intermetallic compounds has been observed when nickel particles are incorporated to magnesium via an ingot metallurgy process [S. F. Hassan, M. Gupta, J. Mat. Sci. 37 (2002) 2467]. Formation of the magnesium-nickel intermetallic compounds limits the understanding of the effect of ductile elemental nickel particles on mechanical performance of nickel-reinforced magnesium composites. However, formation of the brittle magnesium-nickel intermetallic compounds might be significantly reduced [A. A. Nayeb-Hashemi, J. B. Clark, Bul. Alloy Phas. Diag 6 (3) (1985) 238], if not ruled out completely, when incorporation of elemental nickel particle in the nickel-reinforced magnesium composites is performed via a solid state processing (e.g. cold-press/sinter).

In view of the forgoing, one objective of the present invention is to produce a reinforced magnesium composite via a blend/cold-press/sinter method, wherein elemental nickel particles and one or more ceramic particles are dispersed within elemental magnesium particles without having intermetallic bonds between elemental nickel particles and elemental magnesium particles [S. F. Hassan, O. O. Nasirudeen, N. Al-Aqeeli, N. Saheb, F. Patel, and M. M. A. Baig., J. Alloys and Compounds 646 (2015): 333-338; incorporated by reference in its entirety].

BRIEF SUMMARY OF THE INVENTION

According to a first aspect the present disclosure relates to a method of producing a reinforced magnesium composite, involving i) mixing a powder blend comprising elemental magnesium particles, elemental nickel particles, and titanium oxide particles to form a mixed powder blend, wherein the titanium oxide particles and the elemental nickel particles are dispersed within the elemental magnesium particles, ii) cold-pressing the mixed powder blend under a uniaxial compressive load at a temperature of no more than 30° C. to form a magnesium composite billet, iii) sintering the magnesium composite billet at a temperature of at least 500° C. in an inert environment to form the reinforced magnesium composite, wherein the elemental magnesium particles and elemental nickel particles are physically bonded without having intermetallic bonds therebetween.

In one embodiment, the method further involves i) coating an external surface of the magnesium composite billet with colloidal graphite prior to the sintering, ii) extruding the reinforced magnesium composite having a colloidal graphite coating under a second uniaxial compressive load and a temperature of at least 250° C. to form a reinforced magnesium composite extrudate.

In one embodiment, the reinforced magnesium composite is extruded with an extrusion ratio in the range of 12:1 to 20:1.

In one embodiment, each of the uniaxial compressive load and the second uniaxial compressive load is in the range of 150-1,000 tons provided by a hydraulic press.

In one embodiment, the reinforced magnesium composite has a volume fraction of voids of less than 0.01.

In one embodiment, the reinforced magnesium composite extrudate has a volume fraction of voids of less than 0.005.

In one embodiment, the reinforced magnesium composite comprises grains with an average size of 1-3 μm.

In one embodiment, a volume fraction of the elemental nickel particles is less than 0.08 and a volume fraction of the titanium oxide particles is less than 0.01, each being relative to the total volume of the powder blend.

In one embodiment, the method further involves adding ceramic nanoparticles to the powder blend prior to the mixing.

In one embodiment, the ceramic nanoparticles are at least one selected from the group consisting of aluminum oxide, silica, silicon carbide, aluminum nitride, aluminum titanate, barium ferrite, barium strontium titanium oxide, barium zirconate, boron carbide, boron nitride, zinc oxide, tungsten oxide, cobalt aluminum oxide, silicon nitride, titanium carbide, titanium dioxide, zinc titanate, hydroxyapatite, zirconium oxide, and cerium oxide.

In one embodiment, a volume fraction of the ceramic nanoparticles is less than 0.01 relative to the total volume of the powder blend.

In one embodiment, the ceramic nanoparticles have an average particle size in the range of 1-200 nm.

In one embodiment, the mixed powder blend is cold-pressed via a hydrostatic pressure provided by an incompressible fluid.

According to the second aspect the present disclosure relates to a reinforced magnesium composite, including i) a magnesium matrix comprising elemental magnesium particles, ii) elemental nickel particles, iii) titanium oxide particles, wherein the elemental nickel particles and the titanium oxide particles are dispersed within the magnesium matrix, and wherein the elemental magnesium particles and the elemental nickel particles are physically bonded without having intermetallic bonds therebetween.

In one embodiment, an average particle size of the elemental magnesium particles is less than 0.3 mm. In another embodiment, an average particle size of the elemental nickel particles is less than 30 μm. In another embodiment, an average particle size of the titanium oxide particles is in the range of 1-200 nm.

In one embodiment, a volume fraction of the elemental nickel particles is less than 0.08 and a volume fraction of the titanium oxide particles is less than 0.01, each being relative to the total volume of the reinforced magnesium composite.

In one embodiment, the reinforced magnesium composite has at least one of the following mechanical properties relative to a pure magnesium matrix: a) a tensile-to-yield strength ratio at least five times larger than a tensile-to-yield strength ratio of the pure magnesium matrix, b) a hardness at least 30% higher than a hardness in the pure magnesium matrix, c) an ultimate tensile strength at least 25% higher than an ultimate tensile strength in the pure magnesium matrix, d) a failure strain at least 10% higher than a failure strain in the pure magnesium matrix.

In one embodiment, the reinforced magnesium composite further includes at least one ceramic nanoparticle selected from the group consisting of aluminum oxide, silica, silicon carbide, aluminum nitride, aluminum titanate, barium ferrite, barium strontium titanium oxide, barium zirconate, boron carbide, boron nitride, zinc oxide, tungsten oxide, cobalt aluminum oxide, silicon nitride, titanium carbide, titanium dioxide, zinc titanate, hydroxyapatite, zirconium oxide, and cerium oxide. In one embodiment, a volume fraction of the ceramic nanoparticles is less than 0.01 relative to the total volume of the reinforced magnesium composite. In one embodiment, an average particle size of the ceramic nanoparticles is in the range of 1-200 nm.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
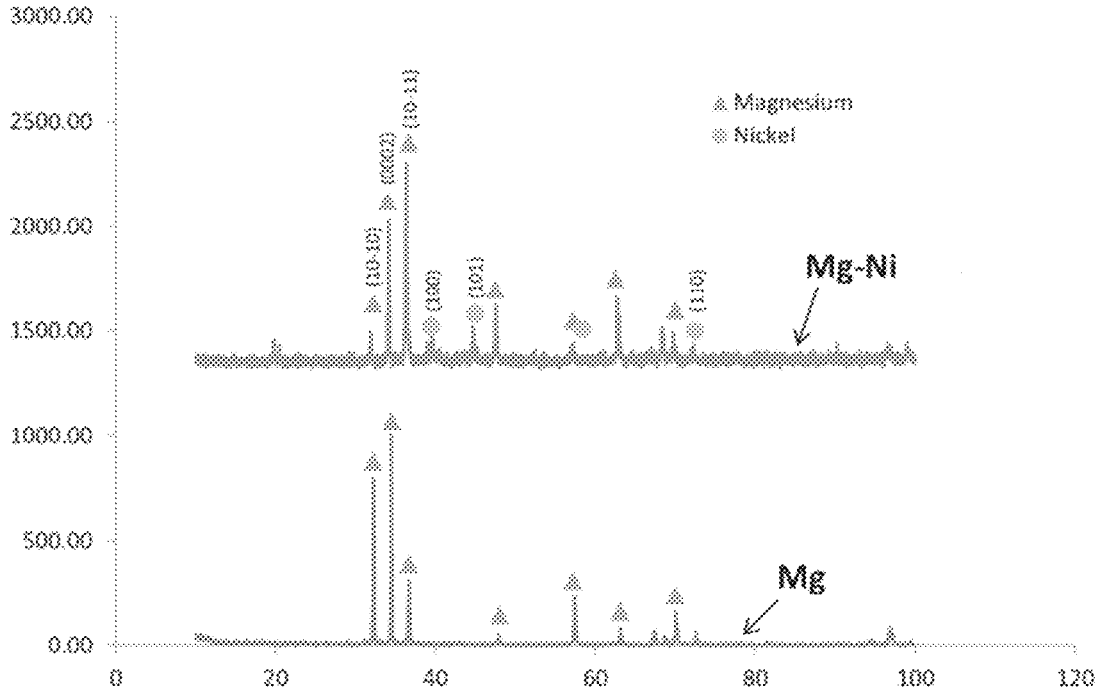
FIG. 1 represents X-ray diffraction spectra of pure magnesium and a reinforced magnesium composite comprising elemental magnesium particles and elemental nickel particles.

According to a first aspect the present disclosure relates to a method of producing a reinforced magnesium composite involving mixing a powder blend comprising elemental magnesium particles, elemental nickel particles, and titanium oxide particles to form a mixed powder blend, wherein the titanium oxide particles and the elemental nickel particles are dispersed within the elemental magnesium particles.

Reinforced magnesium composite as used herein refers to a composite comprising magnesium as a dominant phase and one or more fillers that are dispersed within magnesium. The one or more fillers may be organic or inorganic particles such as metal particles, graphene sheets, carbon nanotubes, fullerenes, ceramic nanoparticles (e.g. metal oxide particles), and/or quantum dots. Incorporation of the one or more fillers may improve characteristics of the magnesium, and thus the reinforced magnesium composite may exhibit improved characteristics including for example strain hardening, failure strain, and/or ultimate tensile strength.

The elemental magnesium particles used herein refer to magnesium particles having an average particle size of less than 0.2 mm, preferably less than 0.1 mm, more preferably less than 0.05 mm, and a purity of at least 97%, preferably at least 98%, more preferably at least 99%, even more preferably at least 99.5%. Similarly, the elemental nickel particles refer to nickel particles having an average particle size of less than 10 μm, preferably less than 5 μm, more preferably less than 2 μm, and a purity of at least 99%, preferably at least 99.5%, more preferably at least 99.9%. The titanium oxide particles are ceramic particles having an average particle size in the range of 1-200 nm, preferably 1-100 nm, more preferably 1-50 nm, and a purity of at least 97%, preferably at least 98%, more preferably at least 99%, even more preferably at least 99.5%.

Mixing refers to a process whereby a powder blend comprising elemental magnesium particles, elemental nickel particles, and titanium oxide particles are blended to form the mixed powder blend. In a preferred embodiment, the titanium oxide particles and the elemental nickel particles are dispersed within the elemental magnesium particles. The particles are preferably mixed at room temperature (i.e. 25° C.), or else they may also be mixed at an elevated temperature (e.g. up to 40° C., or up to 60° C., but no more than 100° C.). In one embodiment, the particles may be mixed in a non-oxidizing environment (e.g. in an inert atmosphere comprising nitrogen, argon, helium, or combination thereof).

In one embodiment, the powder blend is mixed in a centrifugal mixer with a rotational speed of at least 200 rpm, preferably at least 400 rpm, more preferably at least 600 rpm, but no more than 1000 rpm, for at least 1 hour, preferably at least 2 hours, but no more than 3 hours. In a preferred embodiment, no milling ball is used during mixing the powder blend with the centrifugal mixer. In one embodiment, the powder blend is mixed in a roll-milling mixer, wherein a gap size between rollers in the roll-milling mixer is at least 10%, preferably at least 20%, but no more than 50% larger than the largest particle present in the powder blend. For example, if the largest particle present in the powder blend is 0.1 mm, the gap size between rollers in the roll-milling mixer is at least 0.11 mm, or preferably at least 0.12 mm, but no more than 0.15 mm. The powder blend may be mixed in a solvent to form a suspension solution prior to be mixed with the roll-milling mixer. The solvent may have a low boiling point, preferably less than 70° C., or preferably less than 60° C., more preferably less than 40° C., so it could easily evaporate after the mixing being completed. Examples of the solvent may include, chloroform, acetone, methanol, hexane, diethyl ether, tetrahydrofuran, dichloromethane, or any combination thereof. In one embodiment, the suspension solution is sonicated prior to be mixed with the roll-milling mixer.

In one embodiment, a volume fraction of the elemental nickel particles in the powder blend is less than 0.08, preferably less than 0.05, more preferably less than 0.02, even more preferably about 0.015, and a volume fraction of the titanium oxide particles in the powder blend is less than 0.02, preferably less than 0.01, more preferably less than 0.005, even more preferably about 0.0033, with the volume fractions being relative to the total volume of the powder blend. According to this embodiment, a volume fraction of the elemental magnesium particles in the powder blend is at least 0.9, preferably at least 0.95, more preferably at least 0.98.

In one embodiment, the method further involves adding one or more ceramic nanoparticles to the powder blend. In another embodiment, the titanium oxide particles present in the powder blend are replaced with one or more ceramic nanoparticles. Exemplary ceramic nanoparticles include, but are not limited to aluminum oxide, silica, silicon dioxide, silicon carbide, aluminum nitride, aluminum titanate, barium ferrite, barium strontium titanium oxide, barium zirconate, boron carbide, boron nitride, zinc oxide, tungsten oxide, cobalt aluminum oxide, silicon nitride, zinc titanate, hydroxyapatite, zirconium oxide, antimony tin oxide, cerium oxide, barium titanate, bismuth cobalt zinc oxide, bismuth oxide, calcium oxide, calcium titanate, calcium zirconate, cerium zirconium oxide, chromium oxide, cobalt oxide, copper iron oxide, copper oxide, copper zinc iron oxide, dysprosium oxide, erbium oxide, europium oxide, gadolinium oxide, holmium oxide, indium hydroxide, indium oxide, indium tin oxide, iron nickel oxide, iron oxide, lanthanum oxide, lithium titanate, magnesium aluminate, magnesium hydroxide, magnesium oxide, manganese oxide, molybdenum oxide, neodymium oxide, nickel cobalt oxide, nickel oxide, nickel zinc iron oxide, samarium oxide, samarium strontium cobalt oxide, strontium ferrite, strontium titanate, terbium oxide, tin oxide, titanium carbide, titanium carbonitride, titanium dioxide, titanium oxide, titanium silicon oxide, ytterbium oxide, yttrium oxide, yttrium aluminum oxide, yttrium iron oxide, and zinc iron oxide. A volume fraction of the ceramic nanoparticles present in the powder blend is less than 0.02, preferably less than 0.01, more preferably less than 0.005, with the volume fractions being relative to the total volume of the powder blend. In one embodiment, the ceramic nanoparticles have an average particle size in the range of 1-200 nm, preferably 1-100 nm, more preferably 1-50 nm, and a purity of at least 97%, preferably at least 98%, more preferably at least 99%, even more preferably at least 99.5%. In one embodiment, the powder blend is a mixture of elemental magnesium particles and titanium oxide particles, wherein a volume fraction of the titanium oxide particles is less than 0.02, preferably less than 0.01, more preferably less than 0.005. In another embodiment, the powder blend is a mixture of elemental magnesium particles and one or more ceramic nanoparticles, wherein a volume fraction of the one or more ceramic nanoparticles is less than 0.02, preferably less than 0.01, more preferably less than 0.005.

In another embodiment, quantum dots are added to the powder blend to modify electronic properties (e.g. bandgap) of the reinforced magnesium composite. Quantum dots are tiny particles of a semiconducting material having diameters in the range of 1-50 nm, preferably 1-20 nm, more preferably 2-10 nm. Accordingly, core-type quantum dots, core-shell quantum dots, and/or alloyed quantum dots may be incorporated in the composition of the reinforced magnesium composite. Core-type quantum dots may refer to single component particles with uniform internal compositions, such as chalcogenides (i.e. selenides or sulfides) of metals (e.g. CdSe or ZnSe). Core-shell quantum dots may refer to multi-component particles having a core, which is made of a first semiconducting material, and a shell of a second semiconducting material deposited around the core. For example, core-shell quantum dots may be made from a titanium oxide core with zinc oxide nanowires grown on the core. Alloyed quantum dots may be formed by alloying together two or more different semiconducting materials having different electronic properties (e.g. CdSe/ZnS or CdS/ZnS). Other examples of the quantum dots that can be added to the powder blend include, but are not limited to PbS core-type quantum dots, CdSe/ZnS core-shell type quantum dots, CdSeS/ZnS alloyed quantum dots, CdTe core-type quantum dots, InP/ZnS quantum dots, and PbSe core-type quantum dots.

The method further involves cold-pressing the mixed powder blend under a uniaxial compressive load at a temperature of no more than 35° C., preferably no more than 30° C., more preferably no more than 25° C. to form a magnesium composite billet. Cold-press as used herein refers to a process whereby a metal powder is compacted in a die under an extremely high pressure at a temperature close to room temperature. In one embodiment, the mixed powder blend, which is located in a die, is cold-pressed with a uniaxial compressive load provided by a hydraulic press. The uniaxial compressive load may be applied to the mixed powder blend in a vertical orientation or a horizontal orientation. The uniaxial compressive load may be in the range of 150-1,000 tons, preferably 150-300 tons, more preferably about 150 tons that provides a pressure in the range of 100-800 MPa, preferably 150-700 MPa, more preferably 200-500 MPa. The density of the mixed powder blend may increase by at least 10% preferably at least 15%, more preferably at least 20%, even more preferably at least 25% after being cold-pressed. The uniaxial compressive load may be applied to the mixed powder blend for at least 1 min, preferably at least 2 mins, but no more than 5 mins.

Cold-pressing as used herein is different than hot-pressing. In hot-pressing, a powder is compacted while simultaneously being heated at a temperature that is high enough to induce sintering. Intermetallic compounds may be formed as a result of high pressure and high temperature, when a powder blend comprising at least two metals is hot-pressed. Therefore, in one embodiment, the mixed powder blend is hot-pressed to form a hot-pressed magnesium composite, wherein magnesium-nickel intermetallic compounds are formed. The presence of the magnesium-nickel intermetallic compounds in the hot-pressed magnesium composite may reduce ductility of the hot-pressed magnesium composite. In contrast, the magnesium-nickel intermetallic compounds may not be formed when the mixed powder blend is cold-pressed, and therefore, the reinforced magnesium composite has a higher ductility than that of the hot-pressed magnesium composite.

In cold-pressing, a powder may be compacted in a wet bag (i.e. a molding without having a fixed shape), or in a dry bag (i.e. a fixed-shape molding), however, in hot-pressing, a powder may be compacted only in a dry bag (i.e. a fixed-shape molding).

The magnesium composite billet may have less internal residual stresses, and also less cracks, strains, and laminations, when is cold-pressed. The density of the mixed powder blend may increase by at least 10% preferably at least 15%, more preferably at least 20%, even more preferably at least 25%, but not more than 30% after being cold-pressed, whereas the density of the mixed powder blend may increase by at least 20%, or at least 30%, or at least 40%, but not more than 50% after being hot-pressed. Additionally, reinforced magnesium composite may have a higher porosity (i.e. about 1%, preferably about 0.8%, more preferably less than 0.7%) than the hot-pressed magnesium composite (which has a porosity of less than 1%, preferably less than 0.5%).

In one embodiment, the mixed powder blend is present in a sealed elastomer container and is cold-pressed via a hydrostatic pressure provided by an incompressible fluid (e.g. water or water-oil mixture) at room temperature, wherein a uniform compressive load is applied to the mixed powder blend from all directions. The hydrostatic pressure may be in the range of 200-800 MPa, preferably 200-500 MPa, more preferably 200-400 MPa. The density of the mixed powder blend may increase by at least 10% preferably at least 15%, more preferably at least 20%, after being cold-pressed by the incompressible fluid. The hydrostatic pressure may be applied to the mixed powder blend for at least 1 min, preferably at least 2 mins, but no more than 5 mins.

The magnesium composite billet may have a cylindrical, a cubical, a rectilinear, a rectangular, a conical, a pyramidal, or a spherical geometry. In a preferred embodiment, the magnesium composite billet is cylindrical having a diameter (D) in the range of 10-300 mm, preferably 20-50 mm, more preferably about 35 mm, and a height (H) in the range of 10-400 mm, preferably 20-60 mm, more preferably about 40 mm. The magnesium composite billet may have an aspect ratio (i.e. D/H) in the range of 0.5-1.5, preferably 0.5-1, more preferably about 1.

In a preferred embodiment, the magnesium composite billet is coated with colloidal graphite prior to the sintering. Colloidal graphite may serve as a lubricant for extruding the reinforced magnesium composite. The magnesium composite billet may be held isothermal at a constant temperature in the range of 250-350° C., preferably about 300° C., for at least 1 hour, preferably at least 2 hours, more preferably at least 3 hours, after coating with the colloidal graphite. Coating may be performed by submersing the magnesium composite billet in a colloidal graphite solution. In one embodiment, an entire surface area of the magnesium composite billet is coated with the colloidal graphite solution; however, a fraction of a surface area of the magnesium composite billet may be coated. Accordingly, at least 50%, preferably at least 80%, more preferably at least 90% of a surface area of the magnesium composite billet may be coated. In addition to the colloidal graphite, glass powders, silica particles, silicon adhesive, or a combination thereof may be used as a coating for the magnesium composite billet. The coating may also be applied manually.

The method further involves sintering the magnesium composite billet at a temperature in the range of 300-600° C., preferably 300-500° C., more preferably 400-500° C., even more preferably about 500° C. in a non-oxidizing environment (e.g. in the presence of nitrogen, argon, helium, or combination thereof) to form the reinforced magnesium composite. The reinforced magnesium composite comprises elemental magnesium particles and elemental nickel particles that are physically bonded without having intermetallic bonds therebetween. Sintering as used herein refers to a process of forming a solid mass from a compacted metal powder by heating the compacted metal powder without melting metallic components therein. In one embodiment, the magnesium composite billet is sintered for at least 2 hours, preferably at least 3 hours, but no more than 6 hours. In one embodiment, a volume fraction of voids in the reinforced magnesium composite is less than 0.01, preferably less than 0.008, more preferably less than 0.005, with the volume fraction being relative to the total volume of the reinforced magnesium composite. In one embodiment, the reinforced magnesium composite comprises grains with an average size of 1-5 μm, preferably 1-3 μm, more preferably about 2 μm. Grains refer to crystallites (i.e. crystalline structures) that form when a metal solidifies from a molten state.

In another preferred embodiment, the reinforced magnesium composite is extruded, after being coated, under a second uniaxial compressive load to form a reinforced magnesium composite extrudate. In another embodiment, the reinforced magnesium composite is extruded, without being coated.

Extrusion refers to a process through which objects with a desired cross-section are produced by pushing a material through a die of the desired cross-section. The reinforced magnesium composite may be extruded at room temperature (i.e. 25° C.), however, in a preferred embodiment the reinforced magnesium composite is extruded at a temperature in the range of 250-450° C., preferably 250-350° C., more preferably 250-300° C., even more preferably about 250° C. The second uniaxial compressive load may be in the range of 150-1,000 tons, preferably 150-300 tons, more preferably about 150 tons that provides a pressure in the range of 100-800 MPa, preferably 150-700 MPa, more preferably 200-500 MPa. The density of the reinforced magnesium composite may increase by at least 1% preferably at least 2%, more preferably at least 5%, after being extruded. In one embodiment, the reinforced magnesium composite is extruded with an extrusion ratio in the range of 12:1 to 20:1, preferably 15:1 to 20:1, more preferably 18:1 to 20:1, even more preferably about 19:1. Extrusion ratio refers to a ratio of a cross-sectional area of a material before and after an extrusion. For example, if a cross-sectional area of a material before an extrusion process is A, and a cross-sectional area of the material after the extrusion process becomes B, an extrusion ratio of the extrusion process is A:B. In one preferred embodiment, a volume fraction of voids in the reinforced magnesium composite extrudate is less than 0.005, preferably less than 0.002, more preferably less than 0.001, with the volume fraction being relative to the total volume of the reinforced magnesium composite extrudate.

In one embodiment, the reinforced magnesium composite is a wrought magnesium alloy comprising 0.5-8 vol %, preferably 0.5-3 vol %, more preferably 1-1.5 vol % of elemental nickel, with volume percentage being relative to the total volume of the wrought magnesium alloy. The wrought magnesium alloy may refer to a hot and/or a cold workable magnesium alloy that can take a desirable shape.

The reinforced magnesium composite extrudate may be used in various applications. Example of the applications where the reinforced magnesium composite extrudate may be applicable include, but not limited to car manufacturing, aerospace, electronics, food, pharmaceutical, and sport goods. Depending on the final application of the reinforced magnesium composite extrudate further processing steps may be necessary. For example, the reinforced magnesium composite extrudate may first be polished and then be coated with coloring dyes to be used in car manufacturing and aerospace industries. Or, in another embodiment, the reinforced magnesium composite extrudate may first be wrought to a desired shape, and then be coated with a coating material (e.g. epoxy or polyurethane) to be used as utensils or food containers. The coating material may prevent surface oxidation and corrosion on the reinforced magnesium composite extrudate.

According to the second aspect the present disclosure relates to a reinforced magnesium composite, including a magnesium matrix comprising elemental magnesium particles that are physically bonded. "Physically bonded" as used herein may refer to a condition wherein an intermetallic bond is not present between elemental magnesium particles. Specification of the reinforced magnesium composite is partly discussed in the first aspect of the present disclosure.

The reinforced magnesium composite further includes elemental nickel particles that are dispersed within the magnesium matrix, wherein the elemental magnesium particles and the elemental nickel particles are physically bonded without having intermetallic bonds therebetween. Elemental nickel particles may be agglomerated within the reinforced magnesium composite; however, the size of agglomerations when present is less than 50 μm, preferably less than 20 μm, more preferably less than 10 μm. In a preferred embodiment, intermetallic bonds are not present between elemental magnesium particles and elemental nickel particles at phase boundaries (i.e. at boundaries where elemental magnesium particles and elemental nickel particles meet).

The reinforced magnesium composite further includes titanium oxide particles that are dispersed within the magnesium matrix. Titanium oxide particles may be agglomerated within the reinforced magnesium composite; however, the size of agglomerations when present is less than 1.5 μm, preferably less than 0.75 μm, more preferably less than 0.35 μm.

In one embodiment, the reinforced magnesium composite further includes at least one ceramic nanoparticle selected from the group consisting of aluminum oxide, silica, silicon dioxide, silicon carbide, aluminum nitride, aluminum titanate, barium ferrite, barium strontium titanium oxide, barium zirconate, boron carbide, boron nitride, zinc oxide, tungsten oxide, cobalt aluminum oxide, silicon nitride, zinc titanate, hydroxyapatite, zirconium oxide, antimony tin oxide, cerium oxide, barium titanate, bismuth cobalt zinc oxide, bismuth oxide, calcium oxide, calcium titanate, calcium zirconate, cerium zirconium oxide, chromium oxide, cobalt oxide, copper iron oxide, copper oxide, copper zinc iron oxide, dysprosium oxide, erbium oxide, europium oxide, gadolinium oxide, holmium oxide, indium hydroxide, indium oxide, indium tin oxide, iron nickel oxide, iron oxide, lanthanum oxide, lithium titanate, magnesium aluminate, magnesium hydroxide, magnesium oxide, manganese oxide, molybdenum oxide, neodymium oxide, nickel cobalt oxide, nickel oxide, nickel zinc iron oxide, samarium oxide, samarium strontium cobalt oxide, strontium ferrite, strontium titanate, terbium oxide, tin oxide, titanium carbide, titanium carbonitride, titanium dioxide, titanium oxide, titanium silicon oxide, ytterbium oxide, yttrium oxide, yttrium aluminum oxide, yttrium iron oxide, and zinc iron oxide. These ceramic nanoparticles may be agglomerated within the reinforced magnesium composite; however, the size of agglomerations when present is less than 2 μm, preferably less than 1 μm, more preferably less than 0.5 μm.

In another embodiment, the reinforced magnesium composite further includes quantum dots having a size in the range of 1-50 nm, preferably 1-20 nm, more preferably 2-10 nm. The quantum dots may be core-type quantum dots, core-shell quantum dots, and/or alloyed quantum dots. Exemplary quantum dots may include, but are not limited to PbS core-type quantum dots, CdSe/ZnS core-shell type quantum dots, CdSeS/ZnS alloyed quantum dots, CdTe core-type quantum dots, InP/ZnS quantum dots, PbSe core-type quantum dots, and chalcogenides (i.e. selenides or sulfides) of metals (e.g. CdSe or ZnSe).

In one embodiment, the reinforced magnesium composite comprises elemental nickel particles of less than 0.08, preferably less than 0.05, more preferably less than 0.02, even more preferably about 0.015 by volume relative to the total volume of the reinforced magnesium composite. In one embodiment, the reinforced magnesium composite comprises titanium oxide particles of less than 0.02, preferably less than 0.01, more preferably less than 0.005, even more preferably about 0.0033 by volume relative to the total volume of the reinforced magnesium composite. In one embodiment, the reinforced magnesium composite further comprises the at least one ceramic nanoparticle of less than 0.02, preferably less than 0.01, more preferably less than 0.005, even more preferably about 0.0033 by volume relative to the total volume of the reinforced magnesium composite.

The reinforced magnesium composite may be coated with a lubricant such as colloidal graphite, glass powders, silica particles, silicon adhesive, or a combination thereof, before being extruded. However, a composition of a coated reinforced magnesium composite is substantially similar to that of the reinforced magnesium composite. The lubricant present on the surface of the reinforced magnesium composite may partially, or completely be removed after the reinforced magnesium composite is extruded or wrought.

In one embodiment, the reinforced magnesium composite has a tensile-to-yield strength ratio at least four times, preferably at least five times larger than a tensile-to-yield strength ratio of magnesium. Tensile-to-yield strength ratio as used herein refers to a ratio of ultimate tensile strength (i.e. a maximum stress a material can withstand) of a material to its yield strength (i.e. a stress beyond which a material begins to deform plastically). In one embodiment, the reinforced magnesium composite has an ultimate tensile strength at least 20%, preferably at least 25%, more preferably at least 30% higher than an ultimate tensile strength of magnesium. The ultimate tensile strength of the reinforced magnesium composite may be in the range of 200-300 MPa, preferably 220-260 MPa, more preferably about 250 MPa, whereas the ultimate tensile strength of magnesium may be in the range of 200-220 MPa, preferably 200-210 MPa, more preferably about 200 MPa.

In one embodiment, the reinforced magnesium composite has a hardness at least 25%, preferably 30%, more preferably 35% higher than a hardness of magnesium. Hardness is a measure of a resistance of a solid matter to a permanent deformation when a compressive force is applied. The hardness of the reinforced magnesium composite may be in the range of 50-70, preferably 50-65, more preferably 55-65, whereas the hardness of magnesium may be in the range of 45-50, preferably 45-50.

In one embodiment, the reinforced magnesium composite has a failure strain (i.e. a strain of a material at the point of rupture) at least 10%, preferably at least 15%, more preferably at least 20% higher than a failure strain of magnesium. The failure strain of the reinforced magnesium composite may be in the range of 7-20%, preferably 8-12%, more preferably about 12%, whereas the failure strain of magnesium may be in the range of 5-10%, preferably 7-10%.

In one embodiment, the reinforced magnesium composite has a Young's modulus of about the same as the Young's modulus of magnesium.

In one embodiment, an average grain size in the reinforced magnesium composite is at least two times, preferably at least three times smaller than an average grain size of magnesium. The average grain size in the reinforced magnesium composite may be in the range of 1-5 μm, preferably 1-3 μm, more preferably about 2 μm, whereas the average grain size in the magnesium may be in the range of 5-20 μm, preferably 5-15 μm, more preferably about 10 μm.

In one embodiment, a porosity of the reinforced magnesium composite is less than three times, preferably less than two times larger than a porosity of magnesium. The porosity of the reinforced magnesium composite may be in the range of 0.5-1.5%, preferably 0.5-1%, more preferably about 0.8%, whereas the porosity of the magnesium may be in the range of 0.1-0.3%, preferably 0.15-0.25%, more preferably about 0.2%.

In one embodiment, the reinforced magnesium composite has a density of about the same as the density of the magnesium. The density of the reinforced magnesium composite may be in the range of 1.8-2 g/cm$^3$, preferably 1.8-1.9 g/cm$^3$, more preferably about 1.85 g/cm$^3$, whereas the density of the magnesium may be in the range of 1.7-1.8 g/cm$^3$, preferably 1.73-1.76 g/cm$^3$, more preferably about 1.74 g/cm$^3$.

The reinforced magnesium composite may be used in various applications such as car manufacturing, aerospace, electronics, food, pharmaceutical, medical and sport goods.

The examples below are intended to further illustrate protocols for producing a reinforced magnesium composite, and characterizing material properties thereof, and are not intended to limit the scope of the claims.

Example 1

Commercially pure magnesium powder (provided by Merck KGaA, Germany) with an average size of less than 0.1 mm and a purity of at least 97.5% were used. In addition, elemental nickel particles (provided by Merck KGaA, Germany) with an average particle size of 10 mm and a purity of at least 99% were used as the reinforcement phase. Purity of each of the particles has been specified by the manufacturer.

Example 2

Blend-press-sinter powder metallurgy technique was used for the primary processing of the elemental nickel reinforced magnesium composite processing. Particle of magnesium matrix and nickel reinforcement (equivalent to 1.5 volume percentage) blended together at a speed of 200 rpm for 1 hr to obtain homogeneity using Fritsch Pulverisette 5 planetary ball milling machine. No milling balls or process control agents were used during the blending step. The blended composite powder mixture was cold compacted using a 150 ton uniaxial hydraulic press for 1 min to form billets of 35 mm diameter and 40 mm height. The synthesis of monolithic magnesium (i.e. the pure magnesium) was carried out using similar steps except that no reinforcement particles were added. The green compacted billets were coated with colloidal graphite and sintered in tube furnace (model: MTI GSL-1700X, MTI corporation, USA) at 500° C. for 2-h under argon atmosphere.

Primary processed elemental nickel reinforced and monolithic magnesium billets were hot extruded using an extrusion ratio of 19.14:1 to obtain rods of 8 mm in diameter using a 150 ton hydraulic press. Extrusion was carried out at 250° C. The billets were held at 300° C. for 1 hr in a constant temperature furnace before extrusion. Colloidal graphite was used as lubricant.

Macrostructural characterization of the compacted and extruded elemental nickel reinforced and monolithic magnesium samples did not reveal presence of any macro defects. The outer surfaces were found to be smooth and free of circumferential cracks.

Example 3

Density (ρ) measurements were performed on polished extruded samples of elemental nickel particle reinforced and monolithic magnesium in accordance with Archimedes' principle [S. F. Hassan, M. Gupta, J. Mat. Sci. 37 (2002) 2467]. Distilled water was used as the immersion fluid. The samples were weighed using a Mettler Toledo model AG285 Electronic balance, with an accuracy of ±0.0001 g.

The density and porosity measurements conducted on the extruded elemental nickel reinforced and monolithic magnesium samples are listed in Table 1. The porosity level in both the samples remained below 1% indicating the near net shape forming capability of the blend-press-sinter followed by extrusion process adopted in this study.

TABLE 1

Results of density, porosity and grain morphology characterization

| Materials | Reinforcement (wt %) | Density ($g/cm^3$) Theoretical | Density ($g/cm^3$) Experimental | Porosity (%) | Grain size (μm) |
|---|---|---|---|---|---|
| Mg—0.0Ni | — | 1.74 | 1.734 ± 0.001 | 0.22 | 10.1 ± 5.7 |
| Mg—1.5Ni | 7.3 | 1.85 | 1.830 ± 0.016 | 0.83 | 2.1 ± 0.8 |

Example 4

Polished extruded samples of elemental nickel particle reinforced and monolithic magnesium were exposed to $Cu_{K\alpha}$ radiation (λ=1.5418 Å) with a scan speed of 2 deg/min on an automated Bruker-AXS D8 Advance −40 kv/40 Ma diffractometer. The Bragg angles and the values of interplanar spacing, d, obtained were subsequently matched with standard values [Powder Diffraction File, International Center for Diffraction Data, Swarthmore, Pa., USA, 1991] for Mg, Ni, $Mg_2Ni$ and other related phases.

The X-ray diffraction results corresponding to the extruded elemental nickel reinforced and monolithic magnesium samples were analyzed as shown in FIG. 1. The lattice spacing (d) obtained was compared with standard values for Mg, Ni, $Mg_2Ni$ and various phases of the Mg—O and Ni—O systems, however, only elemental nickel and magnesium was identified.

Example 5

Microstructural characterization studies were conducted on metallographically polished and prepared elemental nickel particle reinforced extruded magnesium samples to investigate reinforcement distribution, interfacial integrity between the matrix and reinforcement, and the grain morphology. JEOL JSM-6460 LV Scanning Electron Microscope (SEM) equipped with Energy Dispersive Spectroscopy (EDS) and Meji MX7100 optical microscope were used in this purpose. Matlab based Line-cut image analysis software was used to determine the grain size in extruded reinforced and monolithic magnesium samples.

Figure 2A:
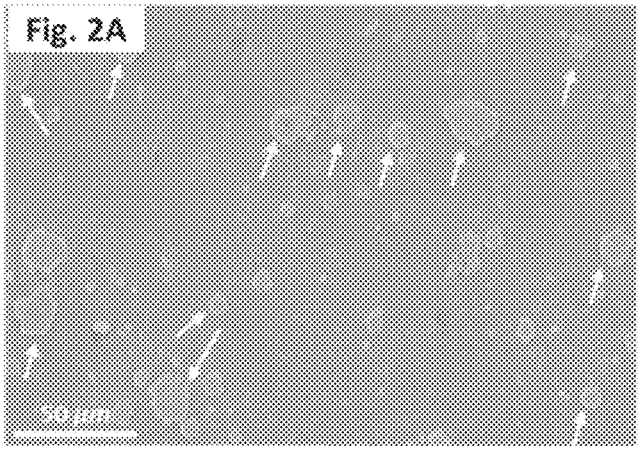
FIG. 2A is a scanning electron micrograph that shows size and dispersion of elemental nickel particles (pointed by arrows) within the reinforced magnesium composite.
Figure 2B:
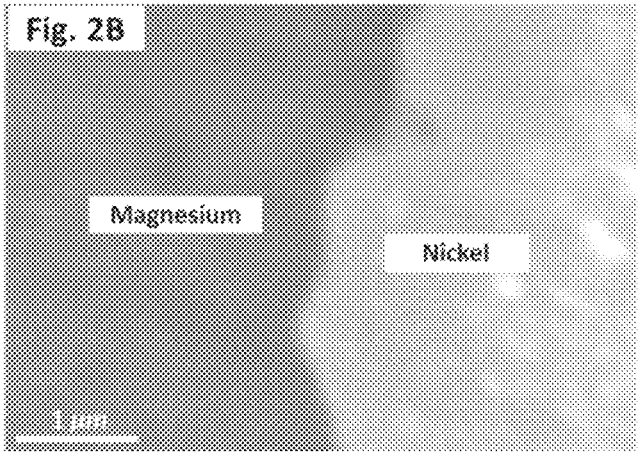
FIG. 2B is a scanning electron micrograph that shows an interface of elemental nickel particles and elemental magnesium particles within the reinforced magnesium composite.

Microstructural characterization revealed fairly uniform distribution of elemental nickel particle in the magnesium matrix with good interfacial integrity as shown in FIG. 2A and FIG. 2B. The interface of nickel particles with the magnesium matrix did not reveal any noticeable presence of nickel-magnesium reaction product, debonded areas or the voids. There was sporadic presence of high-concentration nickel particle zone without cluster. Microstructural characterization also revealed significant refinement in the grains of magnesium matrix due to the presence of fine elemental nickel particles (see FIG. 3A, FIG. 3B, FIG. 3C, and Table 1).

Example 6

Macrohardness and Microhardness measurements were made on the polished elemental nickel particle reinforced and monolithic extruded magnesium samples. Rockwell 15T superficial scale was used for macrohardness measurement in accordance with ASTM E18-03 standard. Microhardness tests were carried out using a load of 50 gf and dwell time of 15 secs on a Beuhler MMT-3 automatic digital microhardness tester in accordance to ASTM E384-08 standard.

The result of macrohardness and microhardness measurement on the extruded elemental nickel particle reinforced and monolithic magnesium samples revealed significant improvement in matrix hardness due to the presence of reinforcement (see Table 2).

Figure 4:
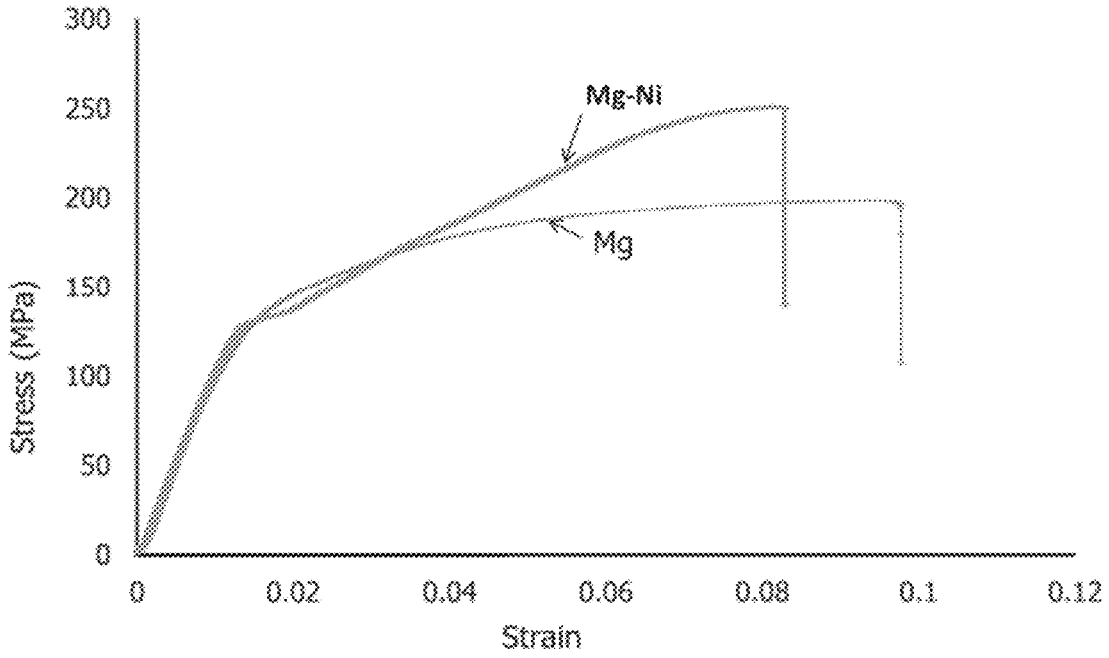
FIG. 4 is the representative stress-strain graphs of the pure magnesium and the reinforced magnesium composite comprising elemental magnesium particles and elemental nickel particles.

An extension-to-failure tensile test on elemental nickel reinforced and monolithic magnesium was carried out using an Instron 3367 machine in accordance with ASTM E8M-01 standard. The tensile tests were conducted on smooth round tension test specimens of diameter 5 mm and gauge length 25 mm with a crosshead speed set at 0.254 mm/min. The result of ambient temperature elongation-to-failure tensile test (see Table 2 and FIG. 4) revealed that tensile strength of the magnesium was significantly improved due to the incorporation of elemental nickel particle, while its yield strength remained unaffected and ductility affected adversely. Results also revealed relatively less energy absorption of magnesium when reinforced with elemental nickel particle.

TABLE 2

Results of mechanical properties characterization

| Material | Macrohardness (15HRT) | Microhardness (HV) | 0.2% YS (MPa) | UTS (MPa) | Failure strain (%) | Energy absorbed ($MJ/m^3$) |
|---|---|---|---|---|---|---|
| Mg—0.0Ni | 49.1 ± 1.4 | 40.0 ± 0.3 | 127 ± 2 | 200 ± 1 | 10.5 ± 0.7 | 17.1 ± 1.3 |
| Mg—1.5Ni | 63.8 ± 1.4 | 54.2 ± 0.8 | 127 ± 2 | 242 ± 10 | 7.6 ± 0.8 | 13.4 ± 2.0 |
| Mg [15] | 46.9 ± 0.8 | 38.9 ± 0.6 | 134 ± 4 | 199 ± 1 | 5.9 ± 1.7 | 10.6 ± 3.9 |

Example 7

Fracture surface characterization studies were carried out on the tensile fractured surfaces of the elemental nickel reinforced and monolithic magnesium samples to provide insight into the fracture mechanisms operative during tensile loading. Fractography was accomplished using a JEOL JSM-6460 LV SEM equipped with EDS.

Figure 5A:
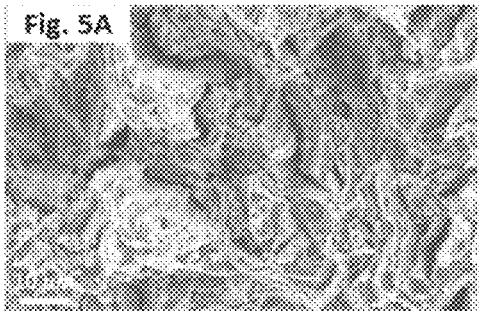
FIG. 5A is a scanning electron micrograph that shows ductile pseudo-dimple features in the pure magnesium.
Figure 5B:
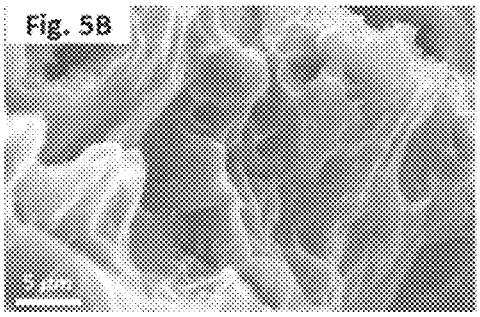
FIG. 5B is a scanning electron micrograph that shows ductile pseudo-dimple features in the pure magnesium, at a higher magnification.
Figure 5C:
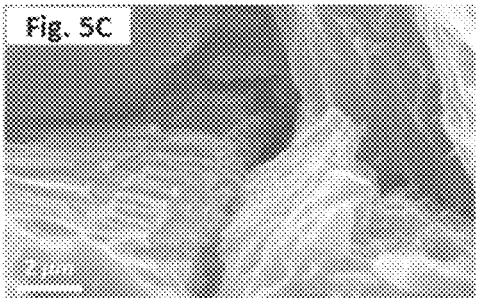
FIG. 5C is a scanning electron micrograph that shows intercrystalline features in the pure magnesium.
Figure 5D:
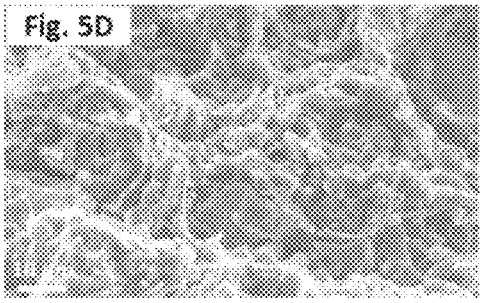
FIG. 5D is a scanning electron micrograph that shows brittle-ductile features in the reinforced magnesium composite comprising elemental magnesium particles and elemental nickel particles.
Figure 5E:
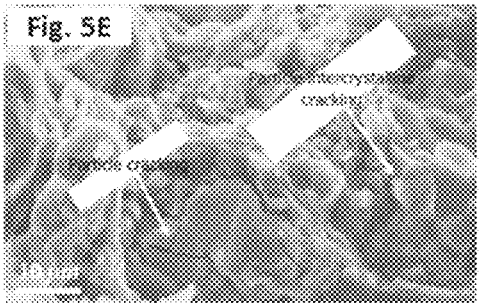
FIG. 5E is a scanning electron micrograph that shows particle cracking features in the reinforced magnesium composite comprising elemental magnesium particles and elemental nickel particles.

Tensile fracture surfaces of extruded monolithic and elemental nickel particle reinforced magnesium are shown in FIG. 5A, FIG. 5B, FIG. 5C, FIG. 5D, and FIG. 5E. Fracture surface of monolithic magnesium samples indicates the presence pseudo-dimple (FIG. 5A and FIG. 5B) and intergranular crack propagation (FIG. 5C). Brittle features with reinforce particle cracking (FIG. 5D and FIG. 5E) was observed in the elemental nickel reinforced magnesium sample fracture surface.

Example 8

Synthesis of elemental nickel particle reinforced and monolithic magnesium was successfully accomplished by blend-press-sinter powder metallurgy technique followed by hot extrusion. No visible defects like oxidation, deformation or surface cracks were observed in compact and sintered billets and as well on the extruded rods. Greater than 99% density (see Table 1) of both the elemental nickel reinforced and monolithic magnesium indicates the appropriateness of processing parameters used in this study. Very large compaction pressure and high extrusion ratio could be attributed as main reason in achieving the high density for the processed materials.

Example 9

Microstructural characterization process of the elemental nickel reinforced magnesium is discussed in terms of: (a) distribution pattern of nickel particle, (b) nickel particle-magnesium matrix interfacial characteristics, (c) grain size, and (d) porosity.

Elemental nickel particles were found to be reasonable uniformly distributed (see FIG. 2A) in the commercially pure magnesium matrix with some sporadic high-particle concentration area. The relative uniform distribution pattern of nickel particle in extruded reinforced magnesium, also supported by almost zero standard deviation in the measured density values (see Table 1) can be attributed to the use of: (i) suitable blending parameters, and (ii) high extrusion ratio. Theoretically, secondary processing with a large enough deformation homogeneously distribute reinforcements regardless of the size difference between matrix powder and reinforcement particulates [S. F. Hassan, M. Gupta, Mater. Sci. Tech. 19 (2003) 253]. Large difference in density between nickel (8.90 $g/cm^3$) and magnesium (1.74 $g/cm^3$) particles [C. J. Smithells, Metals Reference Book, seventh ed., Butterworth-Heinemann Ltd, London, 1992. Cp 14 and 22] could easily result in some extent of nickel particle segregation in the blended magnesium-nickel powder which led to the existence of sporadic high-particle concentrated areas in the extruded reinforced magnesium. Microstructural characterization established presence of elemental nickel particle as reinforcement without any identifiable nickel-magnesium reaction product and could be attributed to the relatively low sintering temperature [A. A. Nayeb-Hashemi, J. B. Clark, Bul. Alloy Phas. Diag 6 (3) (1985) 238] used in this study. Microstructural characterization also revealed defect-free interface formed between elemental nickel reinforcement-magnesium matrix (see FIG. 2B), which was assessed in terms of the presence of debonding and/or microvoid at interface.

Figure 3A:
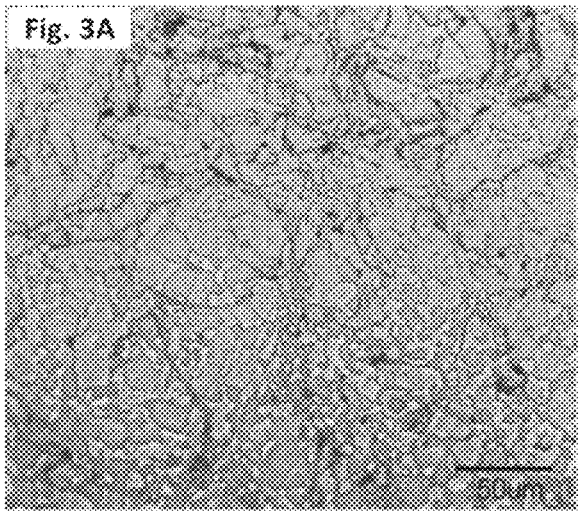
FIG. 3A is an optical micrograph that shows grain morphology in the pure magnesium.
Figure 3B:
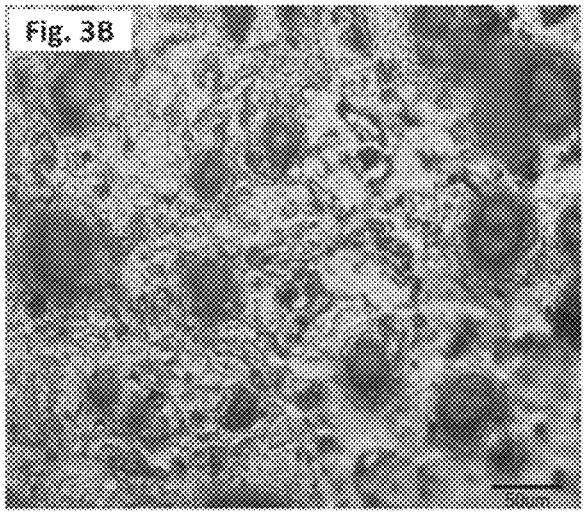
FIG. 3B is an optical micrograph that shows grain morphology in the reinforced magnesium composite.
Figure 3C:
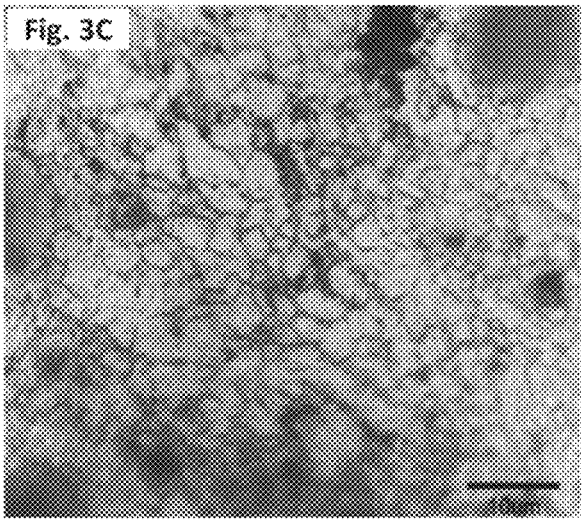
FIG. 3C is an optical micrograph that shows grain morphology in the reinforced magnesium composite, at a higher magnification.

Microstructural characterization of the extruded samples revealed that the presence of elemental nickel particle in the matrix assisted significantly the grain refinement of magnesium (see FIG. 3A, FIG. 3B, FIG. 3C and Table 1). Almost equi-size and shaped fine grain in the elemental nickel reinforced magnesium matrix can be attributed to the cumulative effect of dynamic recrystallization of the matrix with restricted grain growth specifically around the nickel reinforcement particle.

Microstructural characterization revealed negligible presence of minimal porosity in the elemental nickel reinforced magnesium matrix (see Table 1), which can be attributed to the cumulative effect of: (i) appropriate primary processing parameters, (ii) large extrusion ratio, and (iii) good compatibility between magnesium matrix and elemental nickel particles [A. A. Nayeb-Hashemi, J. B. Clark, Bul. Alloy Phas. Diag 6 (3) (1985) 238; N. Eustathopoulos, M. G. Nicholas, B. Drevet, Wettability at High Temperatures, Pregamon Materials Series, U K, 1999]. Earlier studies has established convincingly that an extrusion ratio of as low as 12:1 is capable to nearly close micrometer-size porosity associated to metal-based reinforced materials [D. J. Lloyd, Int. Mat. Rev. 39 (1) (1994); S. F. Hassan, M. Gupta, J. Mat. Sci. 37 (2002) 2467; S. F. Hassan, M. Gupta, Mater. Sci. Tech. 19 (2003) 253; S. F. Hassan, M. Gupta, J. Alloys Compd. 345 (2002) 246; M. J. Tan, X. Zhang, Mater. Sci. Eng. A 244 (1998) 80].

Example 10

The significant increment in both the macrohardness (30%) and microhardness (36%) in the magnesium matrix due to the incorporation of elemental nickel particle can primarily be attributed to the presence of relatively harder reinforcement phase [10,11,21] and reduction in grain size which cumulatively increased the constrain to the localized matrix deformation during the indentation process. It may be noted that hardness results obtained for reinforced magnesium in the present study are similar to the findings reported for metallic and ceramic reinforced magnesium matrices [D. J. Lloyd, Int. Mat. Rev. 39 (1) (1994); S. F. Hassan, K. F. Ho, M. Gupta, Mater. Let. 58 (16) (2004) 2143].

Uniaxial elongation-to-failure tensile test revealed that the strength characteristics of the commercially pure magnesium processed in this study was similar to the values (see Table 2) reported by other's [W. W. L. Eugene, M. Gupta, Adv. Eng. Mater. 7 (4) (2005) 250]. However, the result also revealed that the yield strength of magnesium remained unchanged (see FIG. 4 and Table 2) despite the inclusion of reasonable dispersed and well bonded particles of much stiffer elemental nickel which induced significant grain refinement. The yield stress of a material is the minimum stress required to mobilize dislocations and is governed by the dislocations density and the magnitude of all the obstacles that restricts the motion of the dislocations in the matrix. Yield strength reinforced metal matrix increases due to the presence of: (i) large dislocation density as a result of mismatch between coefficient of thermal expansion and elastic modulus of matrix and reinforcement, and (ii) increasing number of obstacles, stiffer reinforcement particle and grain boundaries in the case of grain refinement, to the dislocation motion [D. J. Lloyd, Int. Mat. Rev. 39 (1) (1994); R. E. Reed-Hill, Physical Metallurgy Principles, second ed., D. Van Nostrand Company, New York, 1964; L. E. Murr, Interfacial Phenomena in Metals and Alloys, Addison-Wesley, Massachusetts, 1975, 25]. The presence of low volume percentage of elemental nickel particle as reinforcement apparently was unable to increase dislocation density significantly during hot extrusion process and as well act as effective barrier to the initiation of dislocation motion. However, onset of plastic deformation led to active dislocation-nickel particle interaction which induced effective strain hardening (see FIG. 4) in the magnesium matrix and significantly increased (21%) the tensile strength.

Failure strain of the monolithic magnesium was found to be good (see Table 2) and reasonably higher that those reported in the literature. Fine grained hexagonal close packed structures matrix with grain boundary dislocation pile-up leading intergranular crack propagation (see FIG. 5B) enhanced the failure strain [Wei Yang, W. B. Lee, Mesoplasticity and its Applications, Materials Research and Engineering, Springer-Verlag, Germany, 1993] of the unreinforced magnesium. On the other hand, cumulative effect of brittle fracture of strain hardened nickel particles and presence of relatively higher level of porosity outweigh the further refinement of the grains in elemental nickel particle reinforced magnesium matrix leading to the relatively poor failure strain. The work of fracture expresses the ability of magnesium matrix to absorb energy up to fracture under tensile load, computed using stress-strain diagram, reduced when incorporated with elemental nickel due to the reduction in failure strain value.

Although the small volume fraction of elemental nickel particles were able to improve the hardness and strength of magnesium, the durability of such a matrix-reinforcement combination should also be considered as a critical issue for a reasonable application especially in the wet atmospheric condition. However, the large anode (magnesium matrix, $E^0_{Mg}=-2.34$ V) to cathode (elemental nickel particle, $E^0_{Ni}=0.25$ V) ratio will result into minimum galvanic corrosion [M. G. Fontana, Corrosion Engineering, McGraw-Hill Book Company, New York, USA, 1987] in the developed material. The developed material, most likely, will experience uniform corrosion, which is safe and predictable. Most potential usage of this developed composite material can be found in close door or dry atmospheric conditions such as interiors of automobile, aerospace, electronics and space applications.

Example 11

Result of fracture surface analysis conducted on the tensile samples fracture surfaces revealed pseudo-dimples (see FIG. 5A and FIG. 5B) and intergranular crack propagation (see FIG. 5C) justifying good ductility value of monolithic magnesium. Brittle fracture features (see FIG. 5D) with the presence of reinforcement particle cracking (see FIG. 5E) were observed in the case of elemental nickel particle reinforced magnesium matrix. Blend-press-sinter powder metallurgy technique coupled with hot extrusion can be used to synthesize elemental nickel particle reinforced magnesium. Reasonable uniform distribution of nickel particles, strong nickel-magnesium interfacial bonding, the absence of nickel-magnesium reaction product, significant grain refinement, and the presence of minimal porosity in microstructure indicate the suitability of primary and secondary processing parameters. Small dispersed elemental nickel is capable in improvement of hardness and ultimate tensile strength of commercially pure magnesium matrix without affecting the yield strength. However, ductility of magnesium matrix was adversely affected by nickel particles. Fracture behavior of magnesium matrix changes from pseudo-ductile to brittle mode dominating by the reinforcement particle breakage under the tensile loading due to the presence of elemental nickel particle.

Example 12

Figure 6:
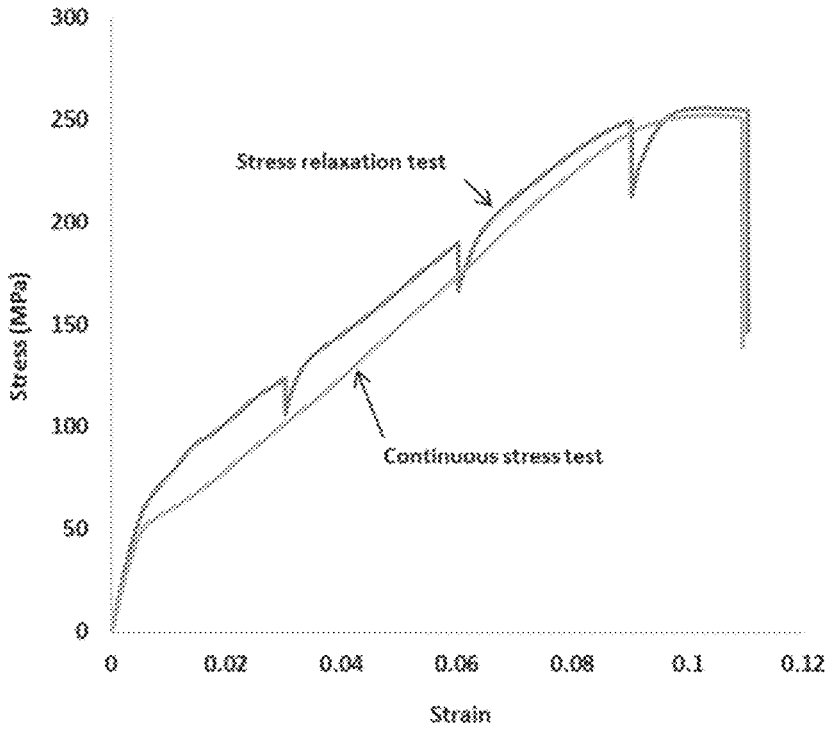
FIG. 6 is the representative stress-strain graphs of a reinforced magnesium composite comprising elemental magnesium particles, elemental nickel particles, and titanium oxide particles under i) a continuous stress test, and ii) a stress relaxation test.

Furthermore, a wrought reinforced magnesium composite (i.e. Mg-7.3Ni-0.8$TiO_2$) is produced via the powder processing (i.e. mechanical blending, cold-pressing, sintering, and hot extruding). Adding a small volume of the hybrid reinforcement (i.e. 1.5 vol % of micrometer size elemental nickel together with 0.33 vol % of nanometer size titanium oxide) to a magnesium matrix was shown to significantly reduce the yield strength, while concurrently improved the ultimate tensile strength and ductility of the composite by enhancing the strain hardening effect. The enhanced strain hardening led to an unexpectedly high tensile-to-yield strength ratio of 5.68 in the reinforced composite (see FIG. 6).

The incorporated reinforcement particles were uniformly distributed in the magnesium matrix via the powder processing method. In addition, microscopic results also revealed a considerable grain refinement in the composite structure, when compared to that of the pure magnesium matrix. Some mechanical characteristics of the composite are listed in Table 3. Accordingly, the reinforced magnesium composite is advantageous over a pure magnesium matrix due to more economic processing routes over traditional powder metallurgy. Additionally, the high ductility and the large strain hardening behavior would make this composite applicable for cold-processing operations. It may also be a good candidate for various industrial applications such as automobile, aerospace, electronics, and sport goods.

TABLE 3

Mechanical properties of the composite and the magnesium matrix

| | Hardness | | 0.2% YS | UTS | Failure Strain |
|---|---|---|---|---|---|
| Material | 15HRT | HV | (MPa) | (MPa) | (%) |
| Reinforced magnesium composite | 64.2 | 60.5 | 44 | 249 | 11.9 |

TABLE 3-continued

| Mechanical properties of the composite and the magnesium matrix | | | | | |
|---|---|---|---|---|---|
| | Hardness | | 0.2% YS | UTS | Failure Strain |
| Material | 15HRT | HV | (MPa) | (MPa) | (%) |
| Pure magnesium matrix | 49.1 | 40.0 | 127 | 200 | 10.3 |

The invention claimed is:

1. A reinforced magnesium composite, comprising:

a magnesium matrix comprising elemental magnesium particles that are physically bonded;

elemental nickel particles, wherein the nickel particles have an average particle size of from 5 μm to 30 μm; and titanium oxide particles;

wherein the elemental nickel particles and the titanium oxide particles are dispersed within the magnesium matrix, and wherein the elemental magnesium particles and the elemental nickel particles are physically bonded without having intermetallic bonds therebetween.

2. The reinforced magnesium composite of claim 1, wherein an average particle size of the elemental magnesium particles is less than 0.3 mm, and an average particle size of the titanium oxide particles is in the range of 1-200 nm.

3. The reinforced magnesium composite of claim 1, wherein a volume fraction of the elemental nickel particles is from 0.015 to 0.08 and a volume fraction of the titanium oxide particles is from 0.0033 to 0.01, each being relative to the total volume of the reinforced magnesium composite.

4. The reinforced magnesium composite of claim 1, which has at least one of the following mechanical properties relative to a pure magnesium matrix:

a tensile-to-yield strength ratio at least five times larger than a tensile-to-yield strength ratio of the pure magnesium matrix;

a hardness at least 30% higher than a hardness in the pure magnesium matrix;

an ultimate tensile strength at least 25% higher than an ultimate tensile strength in the pure magnesium matrix; or a failure strain at least 10% higher than a failure strain in the pure magnesium matrix.

5. The reinforced magnesium composite of claim 1, further comprising:

at least one ceramic nanoparticle selected from the group consisting of aluminum oxide, silica, silicon carbide, aluminum nitride, aluminum titanate, barium ferrite, barium strontium titanium oxide, barium zirconate, boron carbide, boron nitride, zinc oxide, tungsten oxide, cobalt aluminum oxide, silicon nitride, titanium carbide, titanium dioxide, zinc titanate, hydroxyapatite, zirconium oxide, and cerium oxide.

6. The reinforced magnesium composite of claim 5, wherein a volume fraction of the ceramic nanoparticles is from 0.005 to 0.01 relative to the total volume of the reinforced magnesium composite.

7. The reinforced magnesium composite of claim 5, wherein an average particle size of the ceramic nanoparticles is in the range of 1-200 nm.

8. The reinforced magnesium composite of claim 1, wherein the magnesium matrix is a dominant phase and the elemental nickel particles and titanium oxide particles are uniformly dispersed therein.

9. The reinforced magnesium composite of claim 1, wherein the elemental nickel particles are uniformly dispersed within the magnesium matrix and have a particle size of from 5 μm to 10 μm.

10. The reinforced magnesium composite of claim 1, wherein the elemental nickel particles have a phase boundary to the magnesium matrix.

11. The reinforced magnesium composite of claim 1, wherein the titanium dioxide particles are uniformly dispersed only within the magnesium matrix.

* * * * *